United States Patent [19]

Wirz

[11] 4,098,187

[45] Jul. 4, 1978

[54] DEVICE FOR REVERSING THE OPERATION OF GRIPPERS OF A SHEET-TURNING DRUM IN A PRINTING MACHINE FOR PRINTING SELECTIVELY ON ONE OR BOTH SIDES OF A SHEET

[75] Inventor: Arno Wirz, Bammental, Germany

[73] Assignee: Heidelberger Druckmaschinen AG, Heidelberg, Germany

[21] Appl. No.: 733,344

[22] Filed: Oct. 18, 1976

[30] Foreign Application Priority Data

Oct. 17, 1975 [DE] Fed. Rep. of Germany ..... 2546522

[51] Int. Cl.[2] ..... B41F 21/04

[52] U.S. Cl. ..... 101/410; 101/232; 271/82

[58] Field of Search ..... 74/568 R, 569; 271/277, 271/82; 101/230–232, 408–411, 415.1

[56] References Cited

U.S. PATENT DOCUMENTS

| | | | |
|---|---|---|---|
| 3,151,552 | 10/1964 | Peyrebune | 101/409 |
| 3,372,708 | 3/1968 | Hotchkin | 74/568 |
| 3,614,927 | 10/1971 | Jurny | 101/148 |
| 3,682,550 | 8/1972 | Samuels et al. | 271/274 |
| 3,828,673 | 8/1974 | Gazzola et al. | 101/232 |
| 3,941;055 | 3/1976 | Semmler | 101/415.1 |
| 3,973,496 | 8/1976 | Cerny et al. | 101/415.1 |
| 4,014,261 | 3/1977 | Becker | 101/230 |

FOREIGN PATENT DOCUMENTS

| | | | |
|---|---|---|---|
| 2,414,998 | 10/1975 | Fed. Rep. of Germany | 101/411 |

*Primary Examiner*—William Pieprz
*Attorney, Agent, or Firm*—Herbert L. Lerner

[57] ABSTRACT

In a printing machine operable for printing selectively on one or on both sides of a sheet, the printing machine having a sheet-turning drum provided with grippers actuatable by control cams and follower rollers cooperating therewith, the control cams and follower rollers being shiftable relative to one another, a device for reversing the operation of the grippers includes control elements carrying the follower rollers, and a tool insertable into the sheet-turning drum so as to project well beyond the periphery thereof, the tool cooperating with the control elements so as to lift the follower rollers from the control cams during shifting of the control cams and the follower rollers relative to one another.

3 Claims, 2 Drawing Figures

Figure 1:
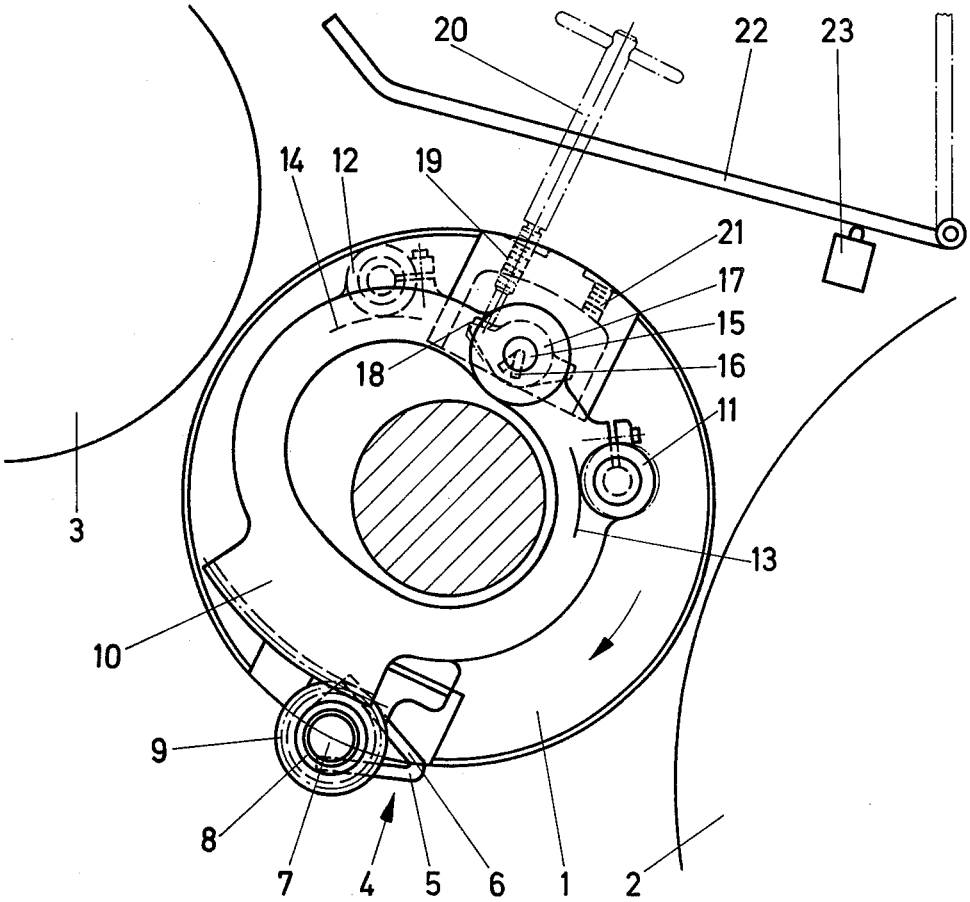

DEVICE FOR REVERSING THE OPERATION OF GRIPPERS OF A SHEET-TURNING DRUM IN A PRINTING MACHINE FOR PRINTING SELECTIVELY ON ONE OR BOTH SIDES OF A SHEET

The invention relates to a device for reversing the operation of grippers of a sheet-turning or turn-over drum in a printing machine for printing selectively on one side (rectoprinting) or both sides (perfecting) of a sheet, which has control cams and follower rollers cooperating therewith that are shiftable relative to one another.

Heretofore known devices of this general type, such as are described, for example, in German Published Non-Prosecuted Application DT-OS No. 1,810,589, serve to change over the printing machine from printing on one side (rectoprinting) to printing on both sides (perfecting) of a sheet and vice versa. The change-over is effected by axially shifting a follower roller, which controls the grippers, relative to two control cams, one of which is constructed for controlling the grippers for printing on a single side (rectoprinting) of a sheet and the other of which is constructed for controlling the grippers for printing on both sides (perfector printing) of a sheet. For the operation of such a device, it is immaterial whether, for example, the follower roller is axially shifted relative to the control cams or whether the follower roller is fixedly mounted while the control cams are axially shifted (German Published Prosecuted Application DT-AS Z No. 133 693). It is similarly immaterial as to how the bearing or mounting of the follower roller is effected and whether it is constructed so as to be axially shiftable with or without roller pins or roller levers.

Due to the varying construction or conformation of the control cams in the heretofore known devices of this general type, the grippers of the sheet-turning drum are controlled for single-side printing (rectoprinting) so that they transfer the sheet unturned to the next succeeding printing unit whereas, for printing as well on the opposite side of the sheet (perfector printing), the grippers grip the sheet at the trailing edge thereof and transfer it in turned-over condition to the next following printing unit. Especially in the case of high-speed printing machines, the follower rollers are pressed with high spring pressure against the control cam in order to prevent the roller from jumping.

A marked disadvantage of the heretofore known devices of this general type is that when the operation of the grippers is reversed, the respective follower roller is subjected to the full spring pressure and can thereby be shifted only with great difficulty on the cam paths or tracks. The same applies also when shifting the respective control cam under the respective follower roller.

In the known devices, the shifting of the rollers or the cams occurs in a region wherein the cam paths or tracks are at the same height or level. In or to effect the shift, the operating personnel must apply a lever tool to the roller or cam, which is difficult to do because of the limited space that is available. The danger also arises that the bearing surfaces of the roller and/or the cams will be damaged during the shifting movement. Damage in the form of marking or flattening of one of the two engaging parts would considerably disturb the operation thereof and impair the opening and closing of the grippers, so that an accurate sheet transfer is no longer assured.

It is accordingly an object of the invention to provide a device for reversing the operation of grippers of a sheet-turning drum in a printing machine for printing selectively on one or both sides of a sheet which avoids the foregoing disadvantages of the heretofore known devices of this general type and by means of which mutual relative shifting of the follower roller or the control cam is afforded in a relatively simple manner and with minimal effort, and removal of an adjusting device before the printing machine is set into operation is reliably assured.

With the foregoing and other objects in view, there is provided, in accordance with the invention, in a printing machine operable for printing selectively on one side or on both sides of a sheet, the printing machine having a sheet-turning drum provided with grippers actuatable by control cams and follower rollers cooperating therewith, the control cams and follower rollers being shiftable relative to one another, a device for reversing the operation of the grippers comprising control elements carrying the follower rollers, and a tool insertable into the sheet-turning drum so as to project well beyond the periphery thereof, the tool cooperating with the control elements so as to lift the follower rollers from the control cams during shifting of the control cams and the follower rollers relative to one another. The instant the roller no longer engages the control cam under spring pressure, it is possible to shift it manually to the next control cam or to shift the control cams with respect to the stationary follower roller, with minimal effort and without requiring the aid of a lever tool. Due to the use of a roller-lifting tool that projects well beyond the periphery of the sheet-turning drum, assurance is provided that the tool will be reliably removed by the operating personnel after the change-over operation is completed. Accidental disturbance of the operation of the printing machine will also be avoided thereby.

In order to enhance the safety of operation of the device and in accordance with another feature of the invention, a safety element is provided which is effective for preventing operation of the printing machine while the tool is inserted in the sheet-turning drum. In this regard electric means are provided which aid the safty element in preventing the printing machine from being started up until the tool has been properly removed from the sheet-turning drum.

In accordance with a further feature of the invention, the device comprises a pivot pin carried by the sheet-turning drum at the respective opposite sides thereof, a respective cam lever formed with a cam being coupled by the respective pivot pin to a respective control element, the sheet-turning drum having a peripheral wall formed with a threaded bore aligned with the cam formed on the cam lever, the tool projecting beyond the periphery of the sheet-turning drum comprising a tommy screw and being screwed into the threaded bore so as to engage the cam lever and thereby lift the respective follower roller from the respective control cam. A simple and reliable device is thereby produced by means of which the follower roller is shiftable while out of contact with the control cam, after loosening a clamping screw.

Other features which are considered as characteristic for the invention are set forth in the appended claims.

Although the invention is illustrated and described herein as embodied in device for reversing the operation of grippers of a sheet-turning drum in a printing machine for printing selectively on one or both sides of a sheet, it is nevertheless not intended to be limited to the details shown, since various modifications and structural changes may be made therein without departing from the spirit of the invention and within the scope and range of equivalents of the claims.

Figure 2:
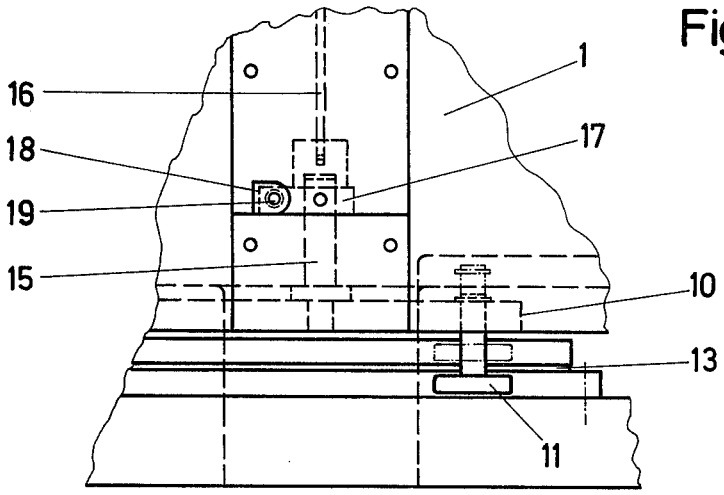

The construction and method of operation of the invention, however, together with additional objects and advantages thereof will be best understoood from the following description of specific embodiments when read in connection with the accompanying drawings, in which:

FIG. 1 is a diagrammatic side elevational view of a sheet turning or turn-over drum in a printing machine for selectively printing on one or both sides of a sheet provided with a device for reversing the operation of the grippers of the turning drum in accordance with the invention; and FIG. 2 is a fragmentary plan view of FIG. 1 showing the reversing device.

Referring now to the figures of the drawing, there is shown therein a sheet turning or turn-over drum, which cooperates in a conventional manner with a transfer drum 2 and an impression cylinder 3 of a printing machine which selectively prints on one side (rectoprinting) or on both sides (perfecting) of a sheet. In the illustrated embodiment, the turning drum 1 is equipped with a tongs-type gripper 4 which firmly holds between both tongs gripper halves 5 and 6 thereof the sheets that are to be transfered or turned. The tongs gripper half 5 is fastened onto a gripper shaft 7, and the tongs gripper half 6 onto a tube 8 surrounding the gripper shaft 7.

The gripper shaft 7 and the tube 8 are separately drivable rotatingly from the respective side of the drum 1 by means of gears 9 and control elements 10. Each of the control elements 10 located on both sides of the drum 1 carries a respective follower roller 11, 12 which cooperate with respective control cams 13, 14.

The control element 10 is fastened on a respective pivot pin 15 and is acted upon by a respective torsion spring 16 which maintains the follower roller 11 in contact with the control cam 13.

A respective cam lever 17 is also fastened on the pivot pin 15 and has a cam 18 aligned with a respective threaded bore 19 formed in a region of the peripheral wall or casing of the drum 1. In order to lift the follower roller 11 from the control cam 13, a tool in the form of a tommy screw 20, shown in phantom in FIG. 1, is screwed into the threaded bore 19 until the cam lever 17 has been turned to a slight extent and the follower roller 11 is thereby lifted. The follower roller 11 can then be shifted on the control cam 13 from one travel path to another thereon as indicated by the solid-line and phantom-line views of the follower roller 11 in FIG. 2.

The lifting of the follower rollers 11 and 12 by means of the tommy screw 20 occurs in sequence i.e. to lift the follower roller 11, the tommy screw 20 is screwed into the threaded bore 19 and, thereafter, to lift the follower roller 12, the tommy screw 20 is removed from the threaded bore 19 and screwed into the threaded bore 21 on the opposite side of the drum 1. Of course, the foregoing sequence may be reversed. After the change-over operation has been completed, the tommy screw 20 is removed from the respective threaded bore 19 or 21 in order to avoid subsequent damage to the printing machine. Due to the fact that the tommy screw 20, as shown in FIG. 1, projects far beyond the periphery of the sheet turning drum 1, assurance is provided that the presence thereof will not go unnoticed by the operating personnel so that the removal thereof by the operating personnel is certain. An additional possibility is afforded of providing, in the region in which the tommy screw 20 is inserted, a safety element in the form of a covering 22 which must be opened in order to be able to insert the tommy screw 20 into the respective threaded bore 19 or 21. In the lowered position of the covering 22 i.e. the position thereof shown in solid lines in FIG. 1, a conventional limit switch 23 is operated thereby in any suitable manner that may be known to any man of ordinary skill in the art to enable the printing machine to be set into operation. Thus, the limit switch 23 may serve as a trigger mechanism for releasing a conventional safety device, so as to permit start-up of the printing machine.

The mode of operation of the aforedescribed embodiment is not changed if, for example, the control cams 13 and 14 are shifted instead of the follower rollers 11 and 12. In such a case also, a load-free shifting of the control cams 13 and 14 is afforded in a very simple manner through lifting the follower rollers 11 and 12 therefrom.

There are claimed:

1. In a printing machine operable for printing selectively in either one of two modes, said modes comprising printing on one side or on both sides of a sheet, a sheet-turning drum provided with grippers, control cams, followers and resilient spring means for biasing said followers and said cams relatively against one another, mechanical linkage means connecting said cams and said followers with the grippers for actuating the same, said followers and said cams being in relative rolling engagement with one another, said control cams and said followers being shiftable relative to one another when changing from one mode of printing to the other in a direction normal to the plane of said relative rolling of said followers and said cams, and said linkage means including control elements carrying said followers, a device for reversing the operation of the grippers when changing from one mode of printing to the other by shifting said followers, on the one hand, and said rollers, on the other hand, relative to the other, comprising a tool insertable into the sheet-turning drum so as to project well beyond the periphery thereof, said tool cooperating with said control elements so as to lift the followers from the control cams against the bias of said spring means during shifting of the control cams and said followers relative to one another.

2. Device according to claim 1 including a safety element effective for preventing operation of the printing machine while said tool is inserted in the sheet-turning drum.

3. Device according to claim 1 comprising a pivot pin carried by the sheet-turning drum at the respective opposite sides thereof, a respective cam lever formed with a cam being coupled by the respective pivot pin to a respective control element, the sheet-turning drum having a peripheral wall formed with a threaded bore aligned with said cam formed on said cam lever, said tool projecting beyond the periphery of the sheet-turning drum comprising a tommy screw and being screwed into said threaded bore so as to engage said cam lever and thereby lift the respective follower roller from the respective control cam.

* * * * *